US006756174B2

(12) United States Patent
Van Vechten et al.

(10) Patent No.: US 6,756,174 B2
(45) Date of Patent: Jun. 29, 2004

(54) THREE DIMENSIONAL ELECTROASSEMBLY

(76) Inventors: James A. Van Vechten, 915 S. Skyland Dr., Lake Oswego, OR (US) 97034; J. Dustin Hultine, 3430 SE. 10th Ave., Portland, OR (US) 97202

( * ) Notice: Subject to any disclaimer, the term of this patent is extended or adjusted under 35 U.S.C. 154(b) by 197 days.

(21) Appl. No.: 10/003,171

(22) Filed: Nov. 14, 2001

(65) Prior Publication Data

US 2003/0091731 A1 May 15, 2003

(51) Int. Cl.[7] ..... G03G 9/08
(52) U.S. Cl. ..... 430/120; 430/126; 430/9
(58) Field of Search ..... 430/120, 126, 430/9

(56) References Cited

U.S. PATENT DOCUMENTS 3,932,751 A 1/1976 Verhile 6,169,872 B1 1/2001 Thayer

OTHER PUBLICATIONS

L. B. Schein; "Electrophotography and Development Physics" (2d Ed.); Book; 1992; pp. 29–32 & 331–332; New York.

*Primary Examiner*—Mark A. Chapman
(74) *Attorney, Agent, or Firm*—Chernoff, Vilhauer, McClung & Stenzel, LLP

(57) ABSTRACT

A process for forming a three dimensional decorative pattern on a product substrate uses electrostatic forces placed on dielectric fibers and electrostatic latent images written either onto an intended product substrate or onto a transfer surface, or both, to assemble three dimensional composite structures of fibers or rod-shaped components in a matrix of a second dielectric material. The fibers or other rod-shaped components may extend from the matrix to form a surface that is either plush or relatively smooth. The transfer surface may be a photoconductor with an electrostatic latent image that is written with controlled light or it can be made of a dielectric material and be rigid and conforming to the intended product substrate or flexible and made to conform to the intended product substrate.

36 Claims, 21 Drawing Sheets

Flow-Chart 1

Flow-Chart 2

Reference PN/3,932,751 (Fig. 4)

THREE DIMENSIONAL ELECTROASSEMBLY

TECHNICAL FIELD

This invention relates to a process for the production of a relatively thick composite of fibrous layers on a base product material which may serve a decorative or structural function, such as artificial wood or similar organic or inorganic dielectric materials, or which may have a plush surface and may be flexible like artificial fur or plush carpet.

BACKGROUND OF THE INVENTION

Wood is a natural composite material comprising fibers in a lignin matrix. The structural and aesthetic qualities of wood are profoundly affected by the arrangement and orientation of the fibers within the matrix, which is called "grain" or "woodgrain". For a very long time markets have highly valued certain woodgrain patterns. As a consequence, the forest products industry is producing large volumes of wood that has been culled out from the production process for products with high structural and aesthetic values. As the supply of mature trees diminishes, the selection of desired grain patterns becomes restricted and expensive.

Much of this scrap wood is separated into its component fibers and lignin by a variety of methods known in the present art. From these components, wood fiber reinforced composite materials have been made by several methods which have good structural properties due to an absence of knotholes and other defects. The arrangement of fibers in these prior-art composites may be either substantially random for products made by extrusion of a mixture of the fiber and matrix material and intended to have isotropic structural properties, or, substantially regular in spacing and orientation for fiberboard products.

To improve aesthetic values, decorative woodgrain patterns are applied to wood fiber reinforced composites, and to a wide variety of other substrates, by known methods including printing and painting. These methods produce an essentially two dimensional product that has the undesired property that the pattern can be obliterated by shallow abrasion. Also, if the product were to be machined after the pattern has been applied, the substrate would be revealed and the decorative pattern would be lost.

For products that have a plush surface, such as fur, there are other problems. Although fur can have excellent thermal insulation and aesthetic values, fur clothing has lost favor in the marketplace due to the killing of the animals that provide it. There is also great expense involved in the sewing together of many pelts of small animals, such as mink, to produce a garment. Thus, there is a market for artificial fur that might attain the valued qualities of the natural product yet be made in large pieces without killing the animals that provide the hair.

BRIEF SUMMARY OF THE INVENTION

The present invention comprises a process that uses electrostatic forces among external electrodes, electrostatic charges placed on dielectric fibers or other, dielectric, rod-shaped components, and electrostatic latent images written either onto the intended product substrate itself or onto a transfer surface, or both, to assemble three dimensional composite structures of said fibers or rod-shaped components in a matrix of a second dielectric material. The fibers or other rod-shaped components may extend from the matrix to form a surface that is either plush or relatively smooth. The process need not employ a transfer surface but it is often convenient to use one when the product substrate is not flat but varies substantially in height and orientation. The transfer surface can be a photoconductor with an electrostatic latent image that is written with controlled light or it can be made of a dielectric material. The transfer surface can be either rigid and conforming to the intended product substrate or it can be a flexible film belt that is made to conform to the intended product substrate with suitable mechanical and/or fluidic apparatus such as rollers and air nozzles.

DETAILED DESCRIPTION OF THE PREFERRED EMBODIMENT

Figure 1:
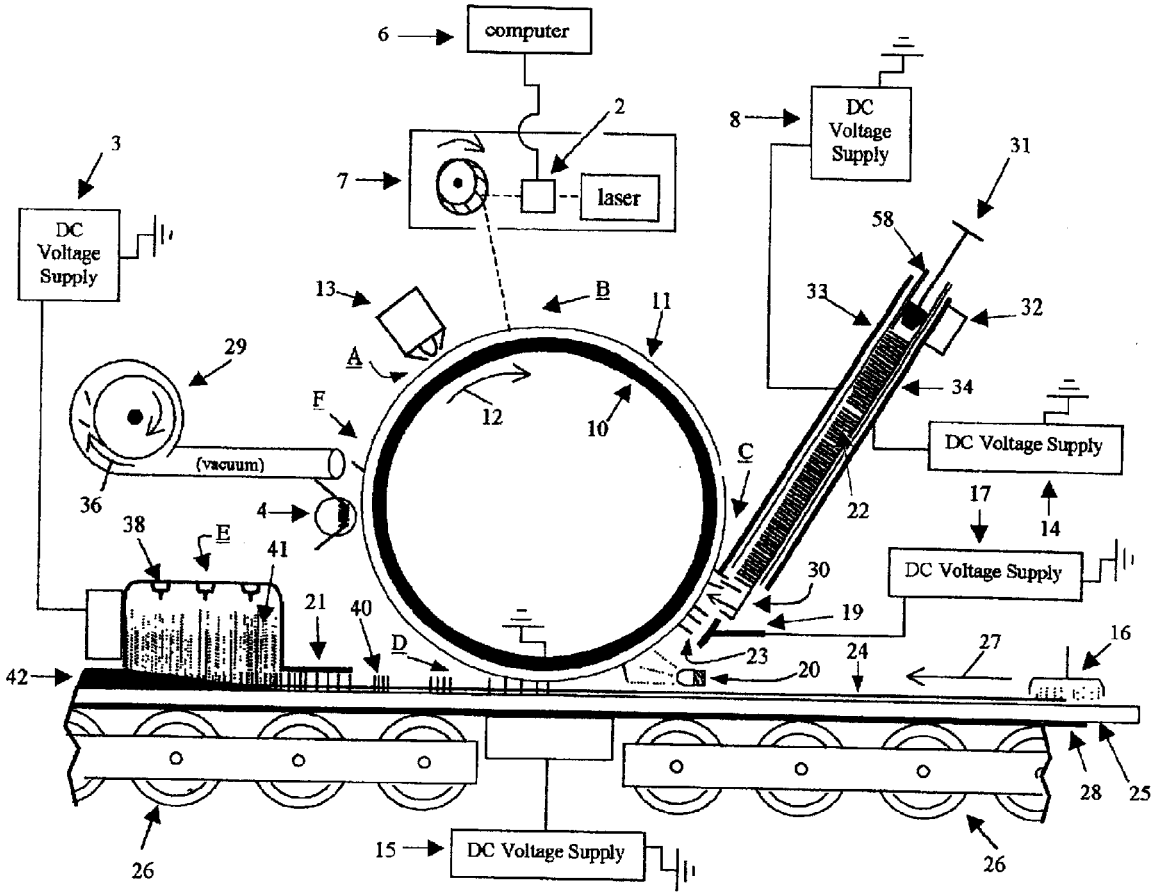
FIG. 1 is a schematic diagram of a first embodiment of the invention that uses a rigid, photoconducting transfer surface.
Figure 1A:
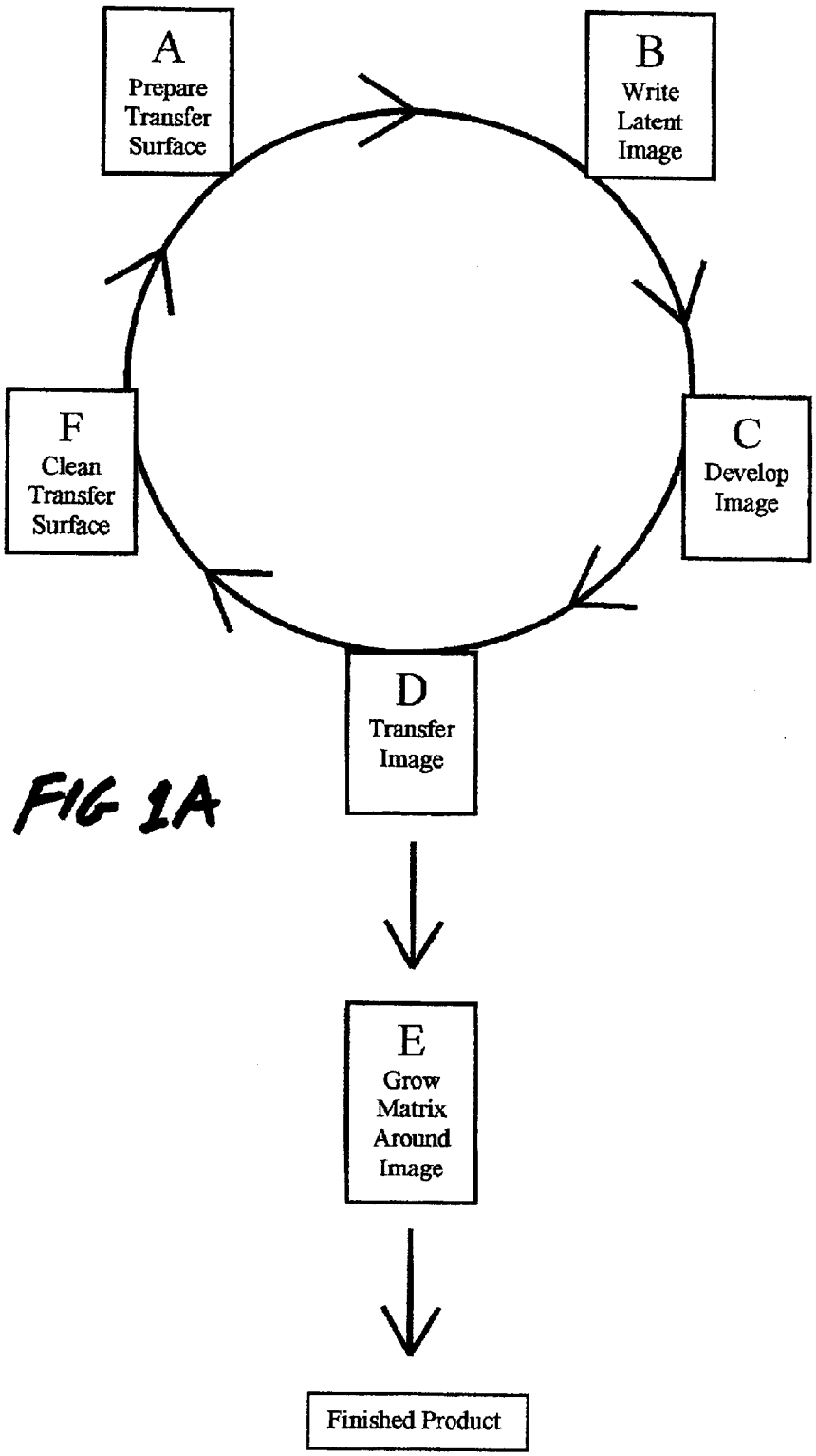
FIG. 1A is a flow chart diagram of the process of the present invention when a transfer surface is used to form and then to transfer the developed image of fibers or other rod-shaped components to the intended product substrate.

When a transfer surface is employed, the process of the present invention proceeds according to the flowchart of FIG. 1A, which explains that the transfer surface is cycled through five stages to transfer a developed image consisting of an aligned array of fibers or other rod-shaped components in a preselected pattern from the transfer surface to the intended product substrate whereupon the surrounding matrix is then grown. The transfer surface is then recycled through its five stages and reused. In a preferred embodiment illustrated in FIG. 1, a transfer surface that is rigid and a photoconductor, which may be selenium, is employed. At Stage A of FIG. 1A, the transfer surface is prepared by the application of a substantially uniform charge, which may be either positive or negative, by the action of a corotron, which (as well-known in the prior art of xerography) contains a wire charged to typically 6 to 10 KV DC (either positive or negative) so as to ionize air, and a surrounding metal enclosure with a slot directed toward the photoconducting surface and charged to typically 600 V DC (either positive or negative but the same polarity as the wire).

At Stage B, a computer controlled, sweeping, focused laser light source, which may be essentially the same as well-known in prior art xerographic printing, writes an electrostatic latent image on the transfer surface by selectively discharging the charge on its photoconducting layer.

Figure 2:
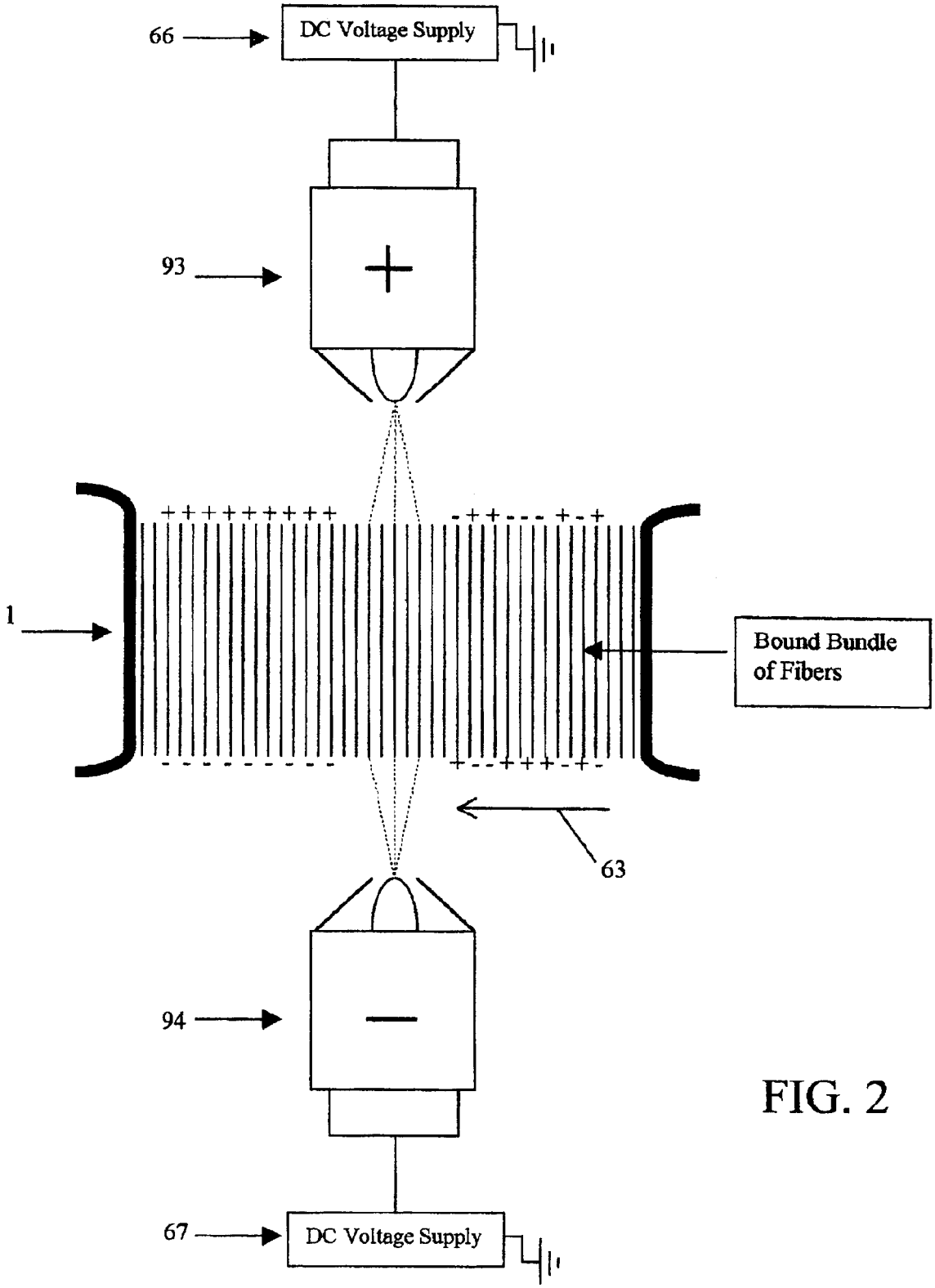
FIG. 2 is a schematic diagram that shows a system for placing charges on the tips of the fibers or other rod-shaped components before they are loaded into the supply tray.

At Stage C, the electrostatic latent image on the transfer surface is developed by attachment of fibers or other rod-shaped components to the charged spots of the image. The fibers or other rod-shaped components are extracted from a nearby tray by action of the electrostatic force between the charged spots of the image and charges induced on the tips of the fibers or other rod-shaped components. A convenient and practical method to provide these charges on the tips of the fibers or other rod-shaped components is illustrated in FIG. 2, which shows the charges being applied before the fibers or other rod-shaped components are loaded into the tray by two corotrons 93, 94 passing over bundles of them while they are restrained by dielectric bands. The bands are required to prevent the fibers or rod-shaped components from separating due to the electrostatic repulsion of the charges on their tips, and to prevent them from bending head-to-toe due to the electrostatic attraction of the charges on the two ends. While on the transfer surface, the fibers or other rod-shaped components stand perpendicular to that surface due to the action of electrostatic forces, which may be enhanced by electrodes.

At Stage D, the patterned array of fibers or other rod-shaped components is transferred from the transfer surface to the intended product substrate.

For the embodiment shown in FIG. 1, the transfer is effected by the action of an adhesive layer to the intended product substrate, the dissipation of the charges of the developed electrostatic image on the photoconductor by illumination from a transfer lamp, and the action of electrostatic forces among the charges on the tips of the fibers or other rod-shaped components and electrodes on either side of the product substrate.

Figure 3:
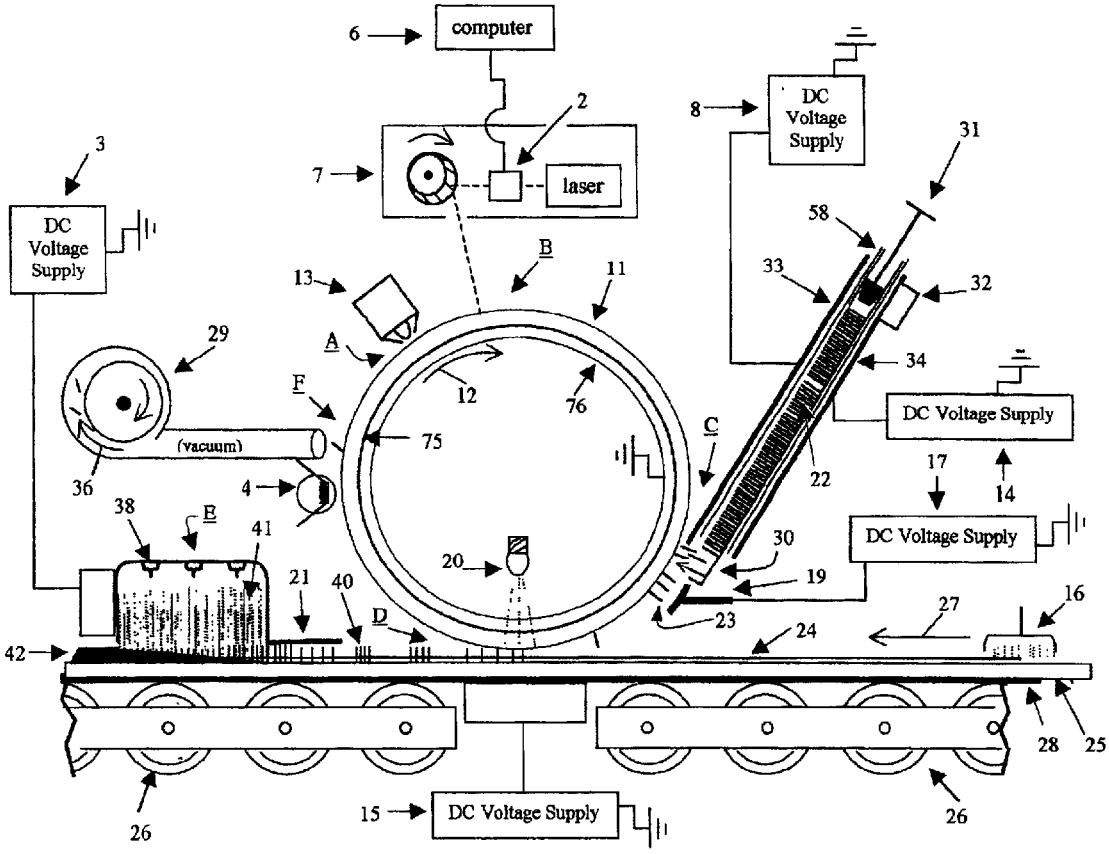
FIG. 3 is a schematic diagram of another embodiment of the invention that shows a transfer lamp of a rigid photoconductor inside a transparent drum.

As illustrated in FIG. 3, the transfer lamp can conveniently be mounted inside the photoconductor if the electrode beneath it is a transparent conductor, such as the materials well-known in the art as indium-tin-oxide (ITO) or as heavily n-type doped zinc-oxide.

At Stage E, the matrix material is grown around the fibers or other rod-shaped components (refer to FIG. 1) by enveloping them in a mist of particles of the matrix material that have an applied charge of the appropriate sign to be attracted to the product substrate in a manner well-known in the prior art of spray painting.

At Stage F of FIG. 1A, the transfer surface is cleaned so that it may be reused. For the embodiment shown in FIG. 1, for which the transfer surface has a photoconducting layer, the cleaning is effected by an erase lamp, which dissipates any remaining electrostatic charges, and a vacuum cleaner, which removes any remaining fibers or other rod-shaped components.

FIG. 1 is a schematic illustration of an apparatus incorporating the inventive features of the present invention to create composite decorative layers 42, which comprise dielectric, rod-shaped components 40 surrounded by a matrix of a different dielectric material 41, on product substrate 25. This apparatus has a photoreceptor drum 10 having a photoconductive transfer surface 11 that is used to transfer developed images consisting of patterned arrays 23 of the rod-shaped components to the product substrate 25. The drum 10 may be metallic or may be glass with a transparent metallic surface (which can be indium-tin-oxide or heavily n-type doped zinc-oxide) just beneath the photoconducting layer 11. In either case the conductive part of drum 10 should be grounded as shown. The drum 10 is rotatably mounted and moves in the direction of the arrow 12 to advance portions of the transfer surface through the various stages that are noted in FIG. 1A. As the drum 10 rotates, transfer surface 11 moves past Preparation Station A where corotron 13 charges the photoconductor transfer surface 11 to a relatively high (~600 V) and substantially uniform degree, either positive or negative. At Image Writing Station B, the laser writing system 7, which comprises a suitable laser with a modulator 2 controlled by computer 6 and a rotating disk with a plurality of mirror facets, projects light onto photoconductor transfer surface 11 to selectively dissipate the charge thereon at selected places. This writes an electrostatic latent image that corresponds to an image selected by the operator that is stored electronically in computer 6.

Thereafter, the drum 10 rotates the electrostatic latent image on the photoconductor transfer surface 11 to Development Station C to develop the electrostatic latent image into a developed image of rod-shaped components 23 standing normal to the photoconductor transfer surface 11. At Development Station C, a supply of rod-shaped components 22 is maintained in tray 30, which is made of material that is insulating electrically and provided with piston 31 and shaker device 32 to keep the rod-shaped components standing in a uniformly dense array as individuals are extracted to develop the image on photoconductor transfer surface 11.

Before these rod-shaped components 22 are loaded into tray 30, both tips are provided with electrostatic charges of opposite sign and magnitude roughly equal to that of the charged spots of the electrostatic latent image on photoconductor 11 by a pair of corotrons 93, 94 as indicated in FIG. 2; the sign of the charge on the upper tips is chosen to be opposite to that of the spots of the electrostatic latent image.

Above and below tray 30 electrodes 33 and 34, which are connected to DC voltage supplies 8 and 14, provide an electrostatic field that acts to keep the rod-shaped components stretched and aligned as shown. Insulating layers 35 on electrodes 33 and 34 prevent electrical conduction between these electrodes and the rod-shaped components 22 in tray 30.

Near the point of closest approach between photoconductor transfer surface 11 and the nearest among the aligned rod-shaped components 22, the electrostatic attraction between these rod-shaped components and the charged spots on photoconductor transfer surface 11 lifts the rod-shaped components 22 from tray 30 and holds them onto photoconductor transfer surface 11. This develops the image with rod-shaped components 23 standing perpendicular to photoconductor transfer surface 11.

As drum 10 continues to rotate this developed image from Station C toward Station D, electrode 19, which is connected to DC voltage supply 17 provides an additional electrostatic field that acts to ensure that the rod-shaped components 23 remain standing perpendicular to photoconductor transfer surface 11.

Drum 10 continues to rotate and advances the rod-shaped components 23 of the developed image to Transfer Station D where they meet product substrate 25, which is moving in the direction of arrow 27 on rollers 26 at the rate corresponding to the rotation of the drum 10. In the alternative, the drum 10 could be moved laterally relative to a stationary substrate. Adhesive applicator 16 applies a sticky surface 24 to product substrate 25 before the rod-shaped components 23 touch the sticky surface 24 on product substrate 25. Just before (~0.1 sec.) this meeting, transfer lamp 20 shines light onto the photoconductor transfer surface 11 in a narrow line across the drum to begin the dissipation of the electrostatic charges of the spots on photoconductor transfer surface 11 so as to release the rod-shaped components therefrom. Thus, the rod-shaped components 23 are transferred to the sticky surface 24 on product substrate 25 in the array of the selected image to become the rod-shaped components 40 tacked on that surface. Also, DC voltage supply 15 and electrode 28 beneath, and DC voltage supply 3 and electrode 21 above, product substrate provide an electrostatic field to aid in keeping the rod-shaped standing perpendicular to sticky surface 24.

In the case that the drum 76 is glass with a transparent metal layer 75, such as indium-tin-oxide (ITO) or heavily n-type doped zinc-oxide, the transfer lamp 20 can be conveniently mounted inside the drum 76 as indicated in FIG. 3.

As drum 10 continues to rotate, photoconductor transfer surface 11 moves past the point of transfer and is illuminated by erase lamp 4, which dissipates any remaining charge across its surface, and vacuum cleaner 29 removes any rod-shaped components 23 (or other material) from its surface at Clean Transfer Surface Station F. Then this part of the photoconductor transfer surface will continue to Station A to begin the process again.

The translation of the product substrate 25 on rollers 26 moves the tacked rod-shaped components 40 from the point of transfer to Grow Matrix Around Image Station E. There, nozzle array 38, which is metallic and electrically connected to electrode 21, sprays charged particles, or a mist, of matrix material 41 onto sticky surface 24 and rod-shaped components 40. The sign of the charge of the particles or mist is such as to attract the particles to the electrode 28 so that the matrix material grows densely and efficiently.

Figure 4:
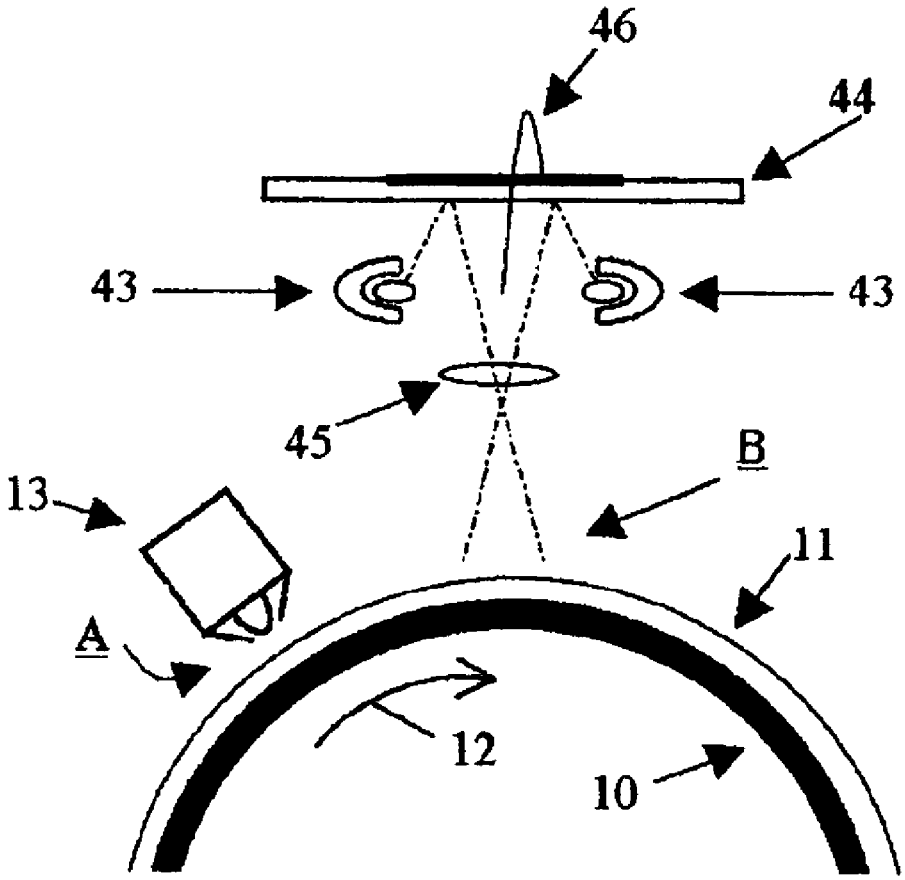
FIG. 4 is a schematic diagram that shows an optical projection system to write an electrostatic latent image onto a transfer surface that uses a photoconducting layer.

FIG. 4 illustrates a second embodiment in which the transfer surface has a rigid photoconducting layer upon which is written the electrostatic latent image (at Stage B of flowchart, FIG. 1A) by optical projection of a master image in the manner well-known in the prior art of xerographic photocopying. Otherwise the process may be the same as is in FIG. 1. At Image Writing Station B (FIG. 1A) a preselected image 46 is positioned face down on a transparent platen 44 for illumination from flash lamps 43. While the drum 10 pauses its rotation, light rays are reflected from the preselected image 46 through a lens 45 and projected onto a charged portion of the photoconductive transfer surface 11 of drum 10 to dissipate the charge thereon selectively. This records an electrostatic latent image corresponding to the preselected image 46. Thereafter, the drum 10 rotates again to bring the portion of the photoconductor transfer surface with this electrostatic latent image to Development Station C.

Figure 5:
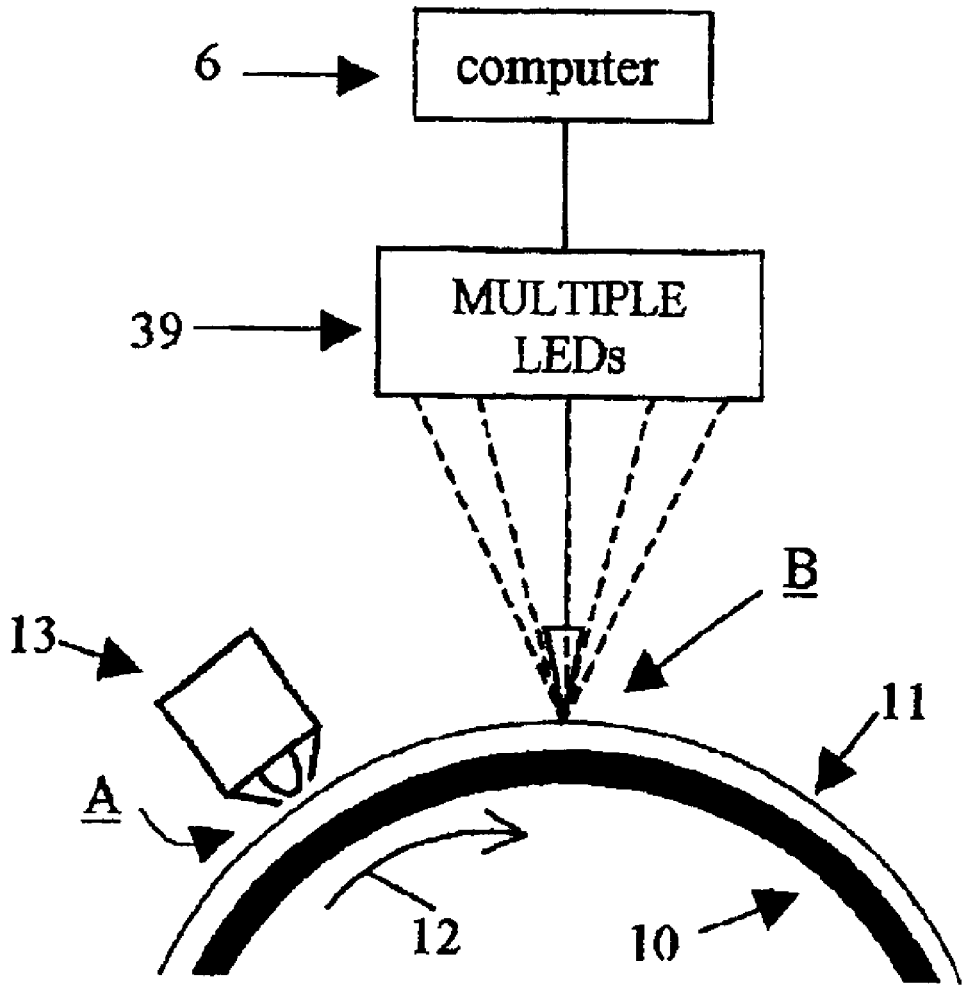
FIG. 5 is a schematic diagram that shows an LED array system to write the electrostatic latent image onto a transfer surface that uses a photoconducting layer.

FIG. 5 illustrates an embodiment in which the transfer surface has a rigid photoconducting layer upon which a computer controlled array of LEDs (light emitting diodes) writes the electrostatic latent image (at Stage B of FIG. 1A) in a manner well-known in the prior art of xerographic printing. Otherwise the process may be the same as in FIG. 1. In FIG. 5 the electrostatic latent image is written on a photoconducting transfer surface 11, which uses apparatus adapted from one type of electrophotographic printer. At Writing Station B (FIG. 1A) while the drum 10 continues to rotate, computer 6 directs a linear array of focused light sources, which may be LEDs or junction lasers, onto a charged portion of the photoconductive transfer surface 11 of drum 10 to dissipate the charge thereon selectively. This records an electrostatic latent image corresponding to the preselected image in accordance electronic information stored within computer 6. As the drum 10 continues to rotate it brings the portion of photoconductor transfer surface 11 with this electrostatic latent image to Development Station C.

Figure 6:
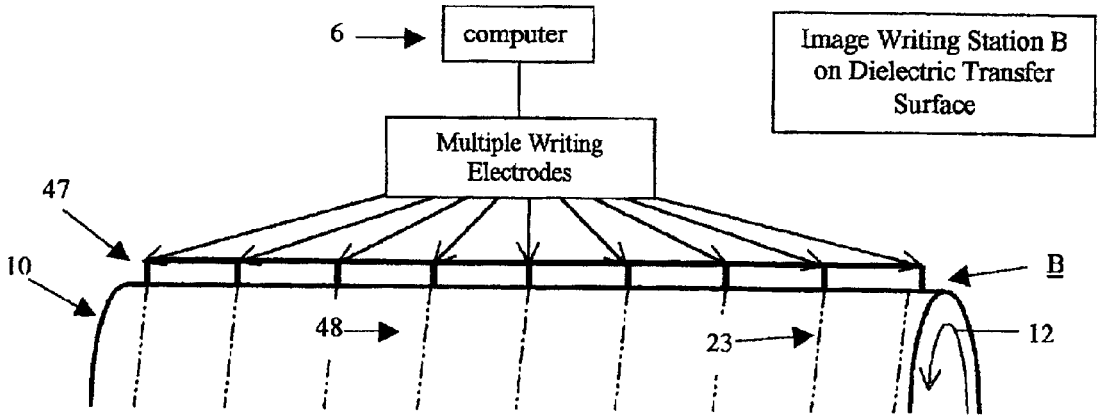
FIG. 6 is a schematic diagram that shows a metallic electrode array system to write the electrostatic latent image onto a transfer surface that uses no photoconducting layer but is simply dielectric.
Figure 7:
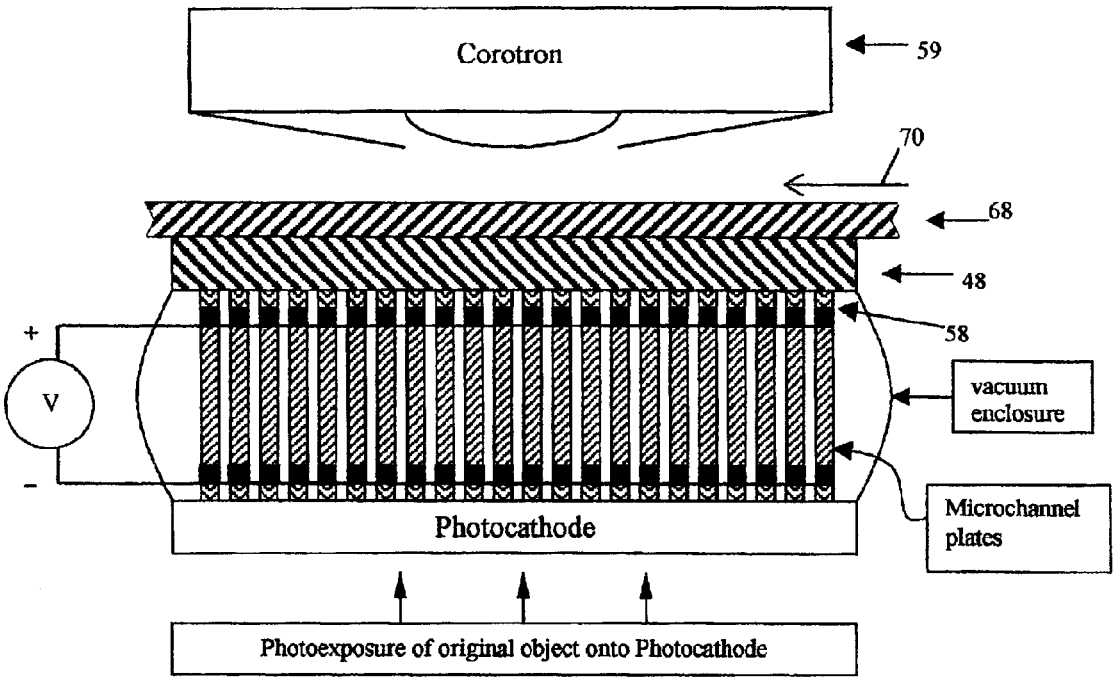
FIG. 7 is a schematic diagram that shows a plasma system to write the electrostatic latent image onto a dielectric transfer surface.

The transfer surface used to practice the present invention need not contain a photoconducting layer. It can simply be dielectric, in which case the electrostatic latent image is written by placing charge directly upon that dielectric transfer surface at Station B of FIG. 1A. FIG. 6 and FIG. 7 illustrate preferred embodiments in which the transfer surface contains no photoconducting layer but is simply dielectric. At Stage B of FIG. 1A, for the case of FIG. 6, a computer controlled array of metal electrodes 47 writes the electrostatic latent image upon this dielectric transfer surface 48 in a manner well-known in the prior art of electrophotography. For the case of FIG. 7, a computer controlled plasma device 50 made according to the invention disclosed in Verhille (U.S. Pat. No. 3,932,751) writes the electrostatic latent image at Stage B onto the dielectric transfer surface. All embodiments that use a transfer surface that contains no photoconducting layer, but simply dielectric layers, omit the transfer lamp and the erase lamp of the embodiments that use a photoconducting transfer surface.

Figure 8:
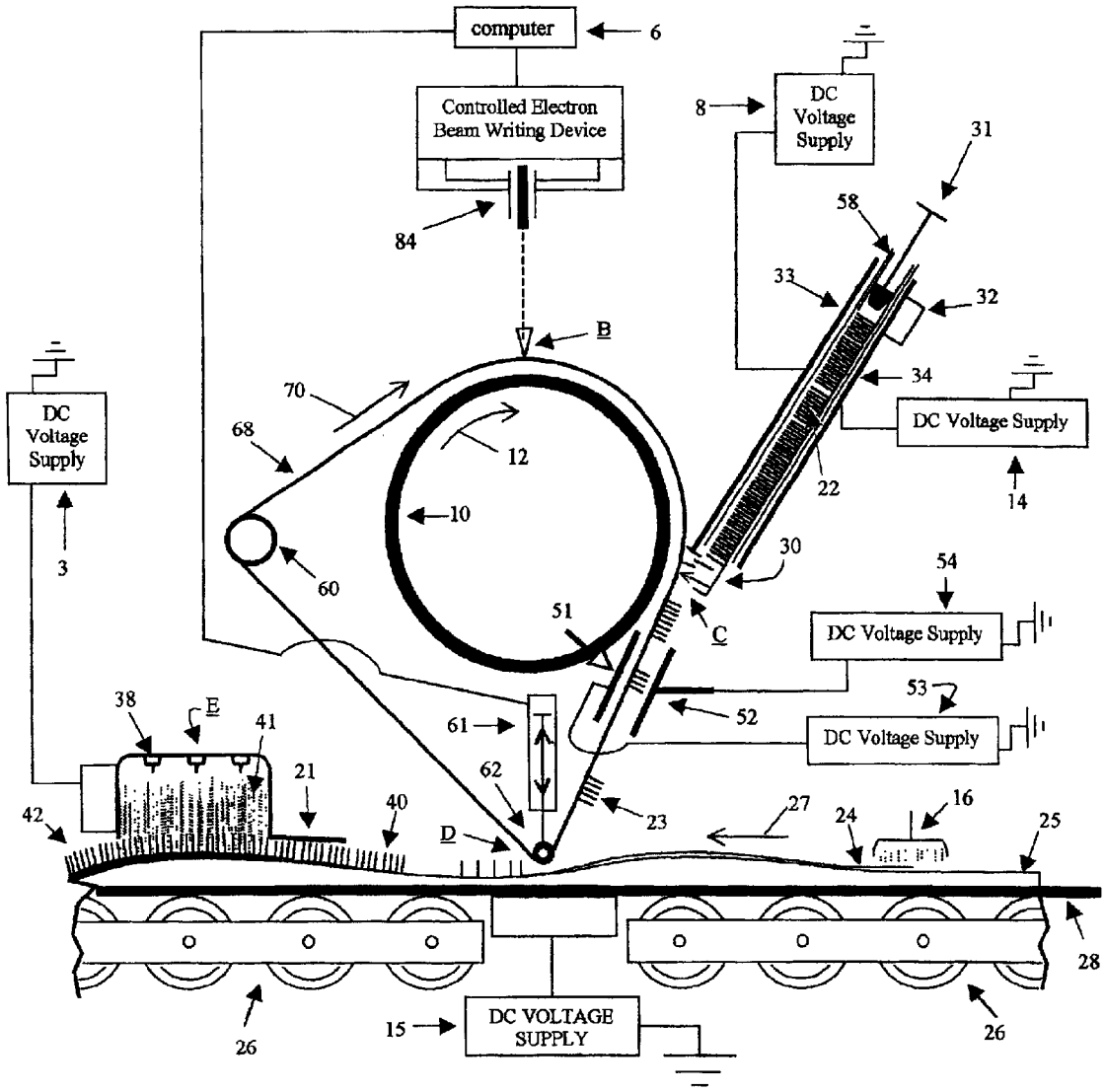
FIG. 8 is a schematic diagram that shows another embodiment of the invention that uses a flexible film dielectric transfer surface belt and an electron beam writing device.

FIG. 8 is a schematic illustration of an apparatus incorporating the inventive features of the present invention to create composite decorative layers 42, which comprise rod-shaped, dielectric components 40 surrounded by a matrix of a different dielectric material 41, on product non-flat substrate 25. The transfer surface 68 is a flexible film dielectric belt. One or more computer controlled floating pistons 61 force this flexible dielectric belt to conform to the passing surface of the intended product substrate 25, which in this case is not flat, so that fibers or other rod-shaped components 22 will transfer properly (at Stage D of FIG. 1A). Tension rollers 60 (with springs not shown) maintain proper tension in the flexible film dielectric belt. The transfer surface used to practice the present invention need not be rigid. Indeed, to form product layers on substrates that are not flat it is often convenient that the transfer surface be a flexible film belt so that it can be made to conform to the non-flat surface. Computer 6 causes one or more floating pistons 61 to raise and lower one or more rollers 62 so that the rod-shaped members 23 of the developed image on the flexible film dielectric transfer surface belt 68 properly meet the adhesive surface 24, which is applied to the intended product substrate 25 by brush applicator 16. Tension roller 60, which is shown without its springs in FIG. 8, maintains proper tension in the flexible film dielectric transfer surface belt 68. In the case shown, the electrostatic latent image is written at Station B of FIG. 1A by one or more computer 6 controlled electron beam devices 84. This illustrates a third method to write the electrostatic latent image onto a substrate that is simply dielectric. At Station C of FIG. 1A, the image is developed with rod-shaped members 22 from supply tray 30 as for the embodiment illustrated in FIG. 1. The rod-shaped components are, as for the embodiment of FIG. 1, prepared with charges on both tips as illustrated in FIG. 2. Electrodes 51 and 52, which are connected to DC voltage supplies 53 and 54, provide an electrostatic field that ensures that the rod-shaped components 23 of the developed image stand perpendicular to the transfer surface 68 as they pass from Station C to Station D of FIG. 1A. As in FIG. 1, the product substrate is moved in the direction of arrow 27 on rollers 26. Electrodes 21 and 28, which are connected to DC voltage supplies 3 and 15 provide an electrostatic field to aid in ensuring that the rod-shaped components 40 remain standing on product substrate 25. For the option illustrated in FIG. 8, the matrix material 41 is grown around the rod-shaped components 40 at Station E of FIG. 1A by the charged mist process from nozzle array 38.

Figure 9:
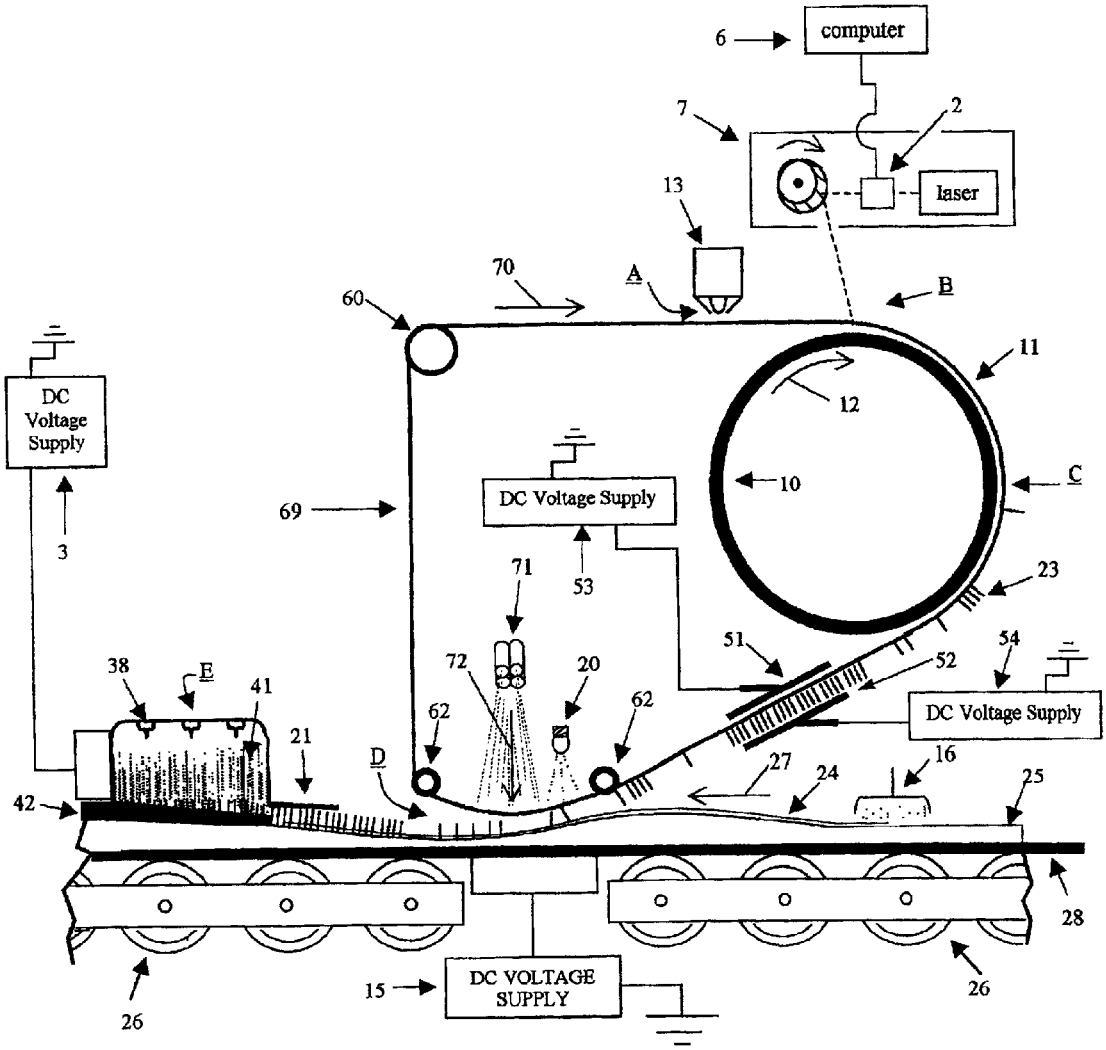
FIG. 9 is a schematic diagram that shows yet another embodiment of the invention that uses air nozzles to cause the flexible film transfer surface belt to conform to the product substrate.

FIG. 9 illustrates an embodiment in which the transfer surface is a flexible film photoconductor belt 69, which may be one of the organic photoconductor belts well-known in the prior art of xerographic photocopying, and at Stage B of FIG. 1A a computer controlled, laser driven device 7 writes the electrostatic latent image. For the option illustrated in FIG. 9, air nozzles 71 are used to force the flexible film photoconductor transfer surface 69 close enough to the passing surface of the intended product substrate 25, which in this case is not flat, so that fibers or other rod-shaped components 23 will transfer properly (at Stage D of FIG. 1A). Tension rollers 60, 62 (with springs not shown) maintain proper tension in the flexible film photoconductor belt. As in FIG. 1, the electrostatic latent image is written at Station B by computer 6 control of modulator 2 in laser driven rotating mirror system 7. Development Station C, which is not shown in FIG. 9, is the same as in FIG. 8, as are the electrodes 51 and 52, which are connected to DC voltage supplies 53 and 54 and which ensure that the rod-shaped components 23 of the developed image stand perpendicular to the flexible film photoconducting transfer surface belt 69 as they move to Transfer Station D of FIG. 1A. In the case illustrated in FIG. 9, the flexible film photoconducting transfer surface belt 69 is forced close enough to the product substrate 25 that the rod-shaped components 23 contact the adhesive surface 24, which is applied by brush applicator 16, by an array of air nozzles 71. Tension rollers 62, which are shown without their springs, maintain proper tension in the flexible film photoconducting transfer surface 69. Transfer lamp 20 shines light onto the flexible film photoconductor transfer surface belt 69 in a narrow line across its surface to begin the dissipation of the electrostatic charges of the spots on the flexible film photoconductor transfer surface 69 so as to release the rod-shaped components therefrom about 0.1 sec. before the rod-shaped components 23 touch the adhesive surface 24. If transfer lamp 20 is inside the thin film photoconductor transfer surface belt (as shown in FIG. 9) and if the electrode beneath the photoconducting layer is aluminized Mylar (as is common for organic xerographic photocopying belt), then the transfer lamp must be relatively intense in order to transmit sufficient light into the photoconducting layer. The Matrix Growth Station E of FIG. 1A and the manner of translation of the product substrate 25 are the same as in FIG. 1 and in FIG. 8. The Preparation Station A and the Cleaning Station F of FIG. 1A, which is not shown in FIG. 9, are the same as in FIG. 1.

The flexible film transfer surface belt used to practice the present invention can also be photoconducting. Those practiced in the art of xerographic photocopying know of practical organic film photoconductors, in particular those made on aluminized Mylar with layers of polyvinyl carbazole and trinitrofluorenone (PVK:TNF) 1:1 molar or the product known in this art as "IBM Emerald". (See L. B. Schein in "*Electro-Photography and Development Physics*" (Springer-Verlag, Berlin, 1992) pp. 29 to 32 and references therein.)

Figure 10A:
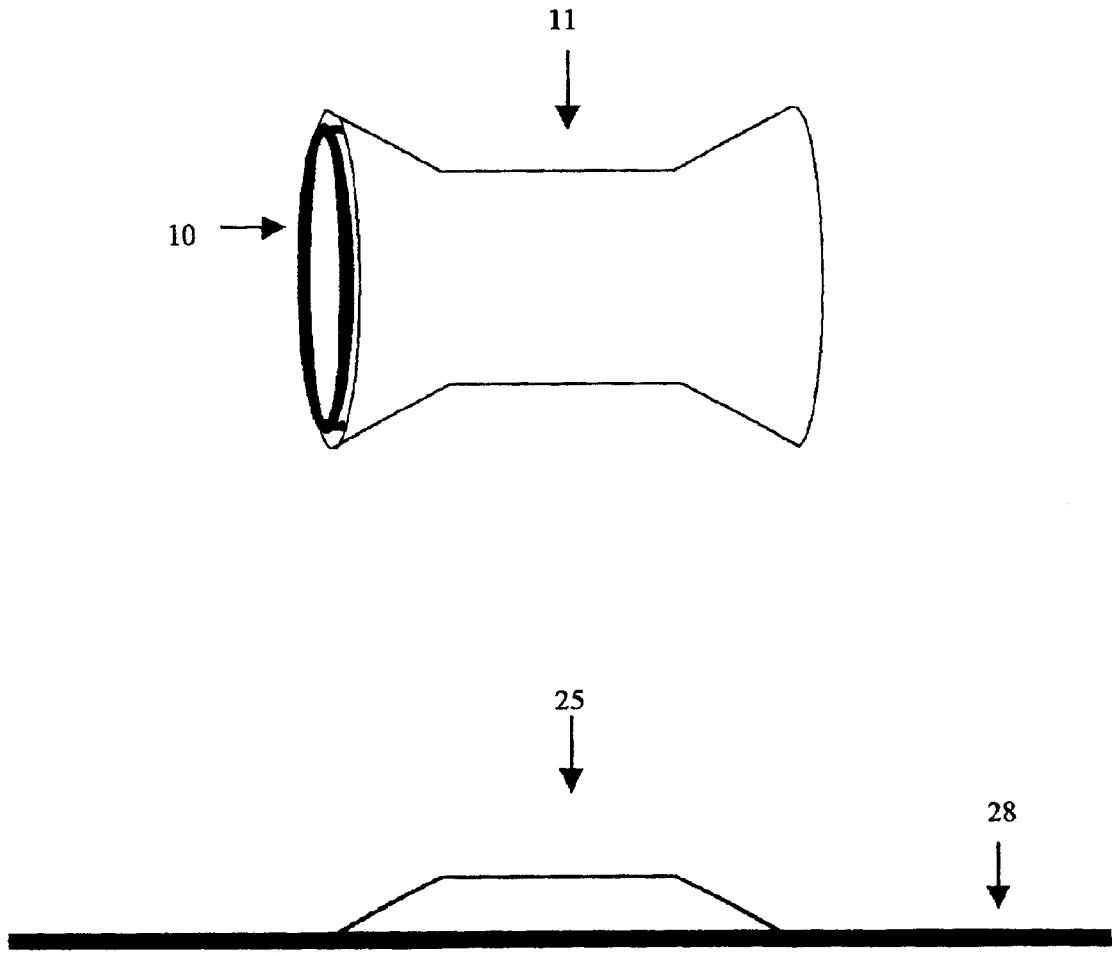
FIGS. 10A and 10B are schematic diagrams that illustrate different shapes for rigid transfer surfaces that conform to intended product substrates that are not flat.
Figure 10B:
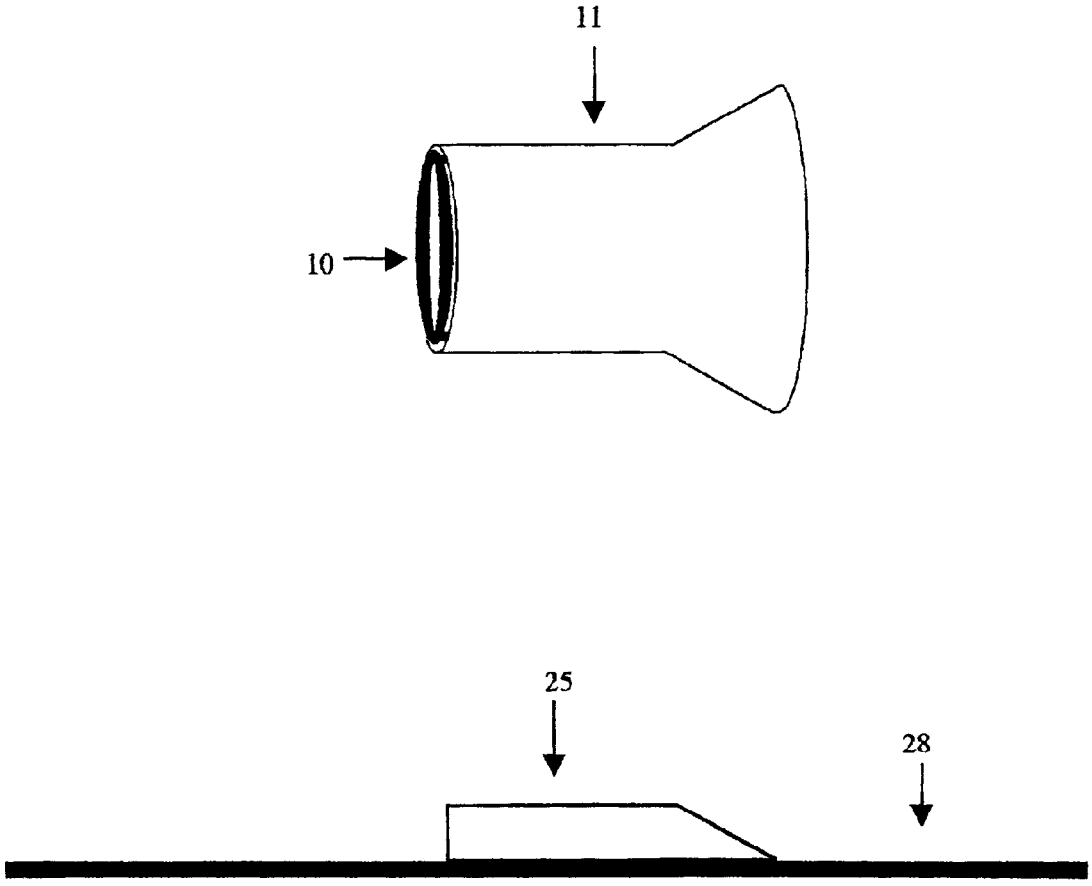

Of course, rigid transfer surfaces with either the dielectric or the photoconducting options can also be made to serve on product substrates that are not flat. In FIG. 10A, the transfer surface 11 is carried by a drum having dual conical-shaped ends so as to mate with the frustum-shaped substrate 25 carried by the electrode 28. In FIG. 10B, the surface 25 has one straight end, and drum 10 and surface 11 are shaped accordingly.

Figure 2A:
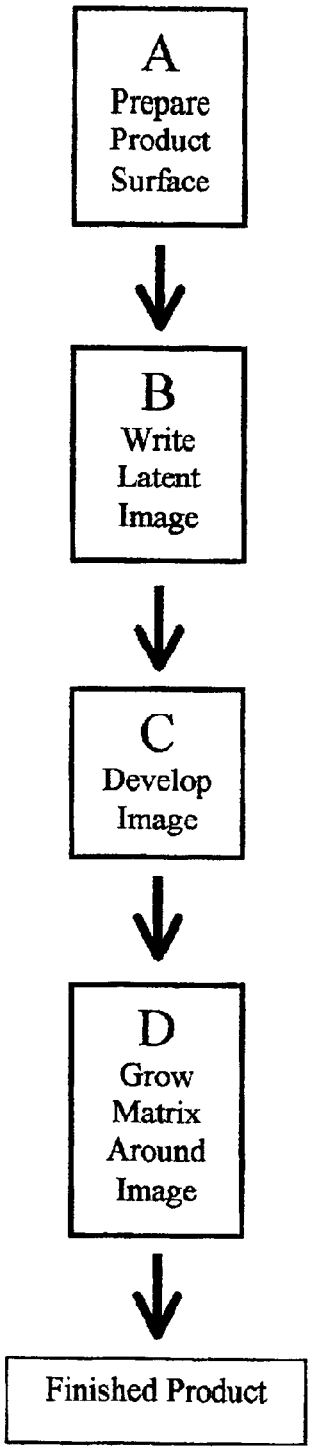
FIG. 2A is a flow chart diagram of the process of the present invention when no transfer surface is used.
Figure 11:
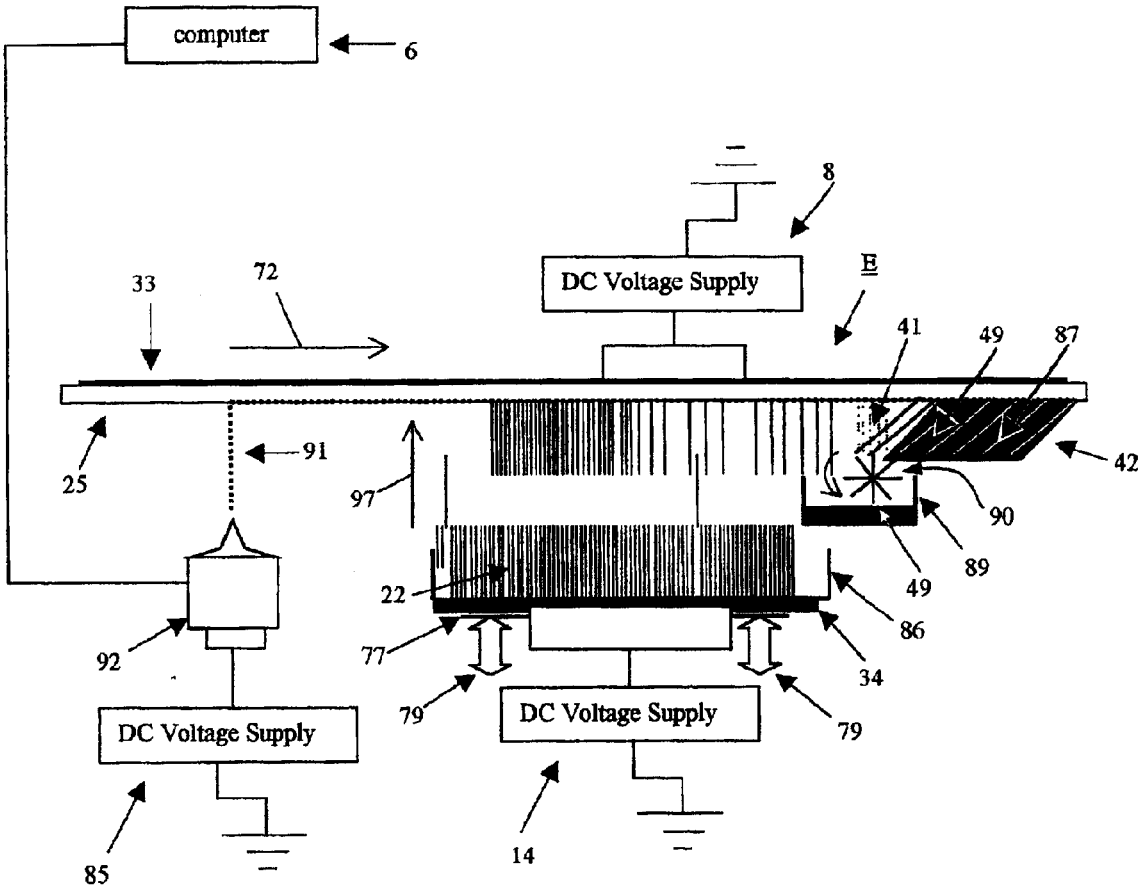
FIG. 11 is a schematic diagram that shows another embodiment of the present invention that does not use any transfer surface.

FIG. 11 illustrates the conceptually simpler variant of the process of this invention for which no transfer surface is employed but the electrostatic latent image is written directly upon the intended product substrate 25. The general case for this variant of the process is indicated in FIG. 2A. For the preferred embodiment illustrated in FIG. 11, at Step B of FIG. 2A, the electrostatic latent image is written with charged drops of adhesive shot from a piezoelectric, drop-on-demand type nozzle array 92, which is generally called an "ink-jet printer". This latent image, which is both adhesive and electrostatic, is developed at Stage C of FIG. 2A by affixing the fibers or other rod-shaped components 22, which have charges on their tips, from a dielectric tray 86 onto the charged, adhesive spots of the image. Thereafter, at Stage D of FIG. 2A, the matrix material is applied to the fibers or other rod-shaped components with a brush 90 that also serves the function (in this embodiment) of bending the fibers or rod-shaped components away from the product surface normal. Thus, the fibers or rod-shaped components need not present an end grain pattern on the product surface.

In FIG. 11, composite decorative layers 42, which comprise rod-shaped, dielectric components 87 are surrounded by a matrix of a different dielectric material 41, which, for the option illustrated in FIG. 11, is applied by rotating brush applicator 91 from matrix material supply tray 94 in such a way as to tip the rod-shaped components 87 to a controlled angle from the normal to the product substrate 25. The electrostatic latent image can be written upon the intended product substrate, as long as its top layer is dielectric, with an array of metal electrodes, as 47 in FIG. 6, or with a plasma writing system, as 50 in FIG. 7, but for the option illustrated in FIG. 11 this is done with an array 92 of what are known in the prior art of ink-jet printing as piezoelectric, drop-on-demand ink-jet printers that are metallic and impel charged drops of adhesive 91. Computer 6 controls this nozzle array to write the desired image using electronic information store therein. The charge on these adhesive drops 91 is provided by the connection of the metallic nozzles 92 to DC voltage supply 85. Therefore, for this option, the latent image on product substrate 25 is both adhesive and electrostatic. As in all previous cases, the rod-shaped, dielectric components 22 are provided with electrostatic charges on both tips, as illustrated in FIG. 2, prior to being loaded into their supply tray. However, for the option illustrated in FIG. 11 the supply tray is somewhat different from those of previously illustrated embodiments. For the embodiment illustrated in FIG. 11, the supply tray 86 is open on top and an electrostatic field to stretch and to align the rod-shaped components 22 in it is provided by electrode 34 below tray 86 and electrode 33 on the far side of the intended product substrate 25. These electrodes 86 and 33 are connected to DC voltage supplies 14 and 8. This electrostatic field also causes the rod-shaped components 40 that develop the image to stand perpendicular to the product substrate 25 until they are tipped by matrix material applicator brush 90. The product substrate 25 is translated, by simple mechanical apparatus that is not shown in FIG. 11, in the direction of arrow 72. For the option illustrated in FIG. 11, the translation of product substrate 25 can be paused periodically while lifter device 79 raises rod-shaped component tray 86 nearer to product substrate 25, or indeed until the rod-shaped components 22 in tray 86 actually touch the charged adhesive drops of the image, to aid in the development of that image, and then again lowers the tray 86.

Figure 12:
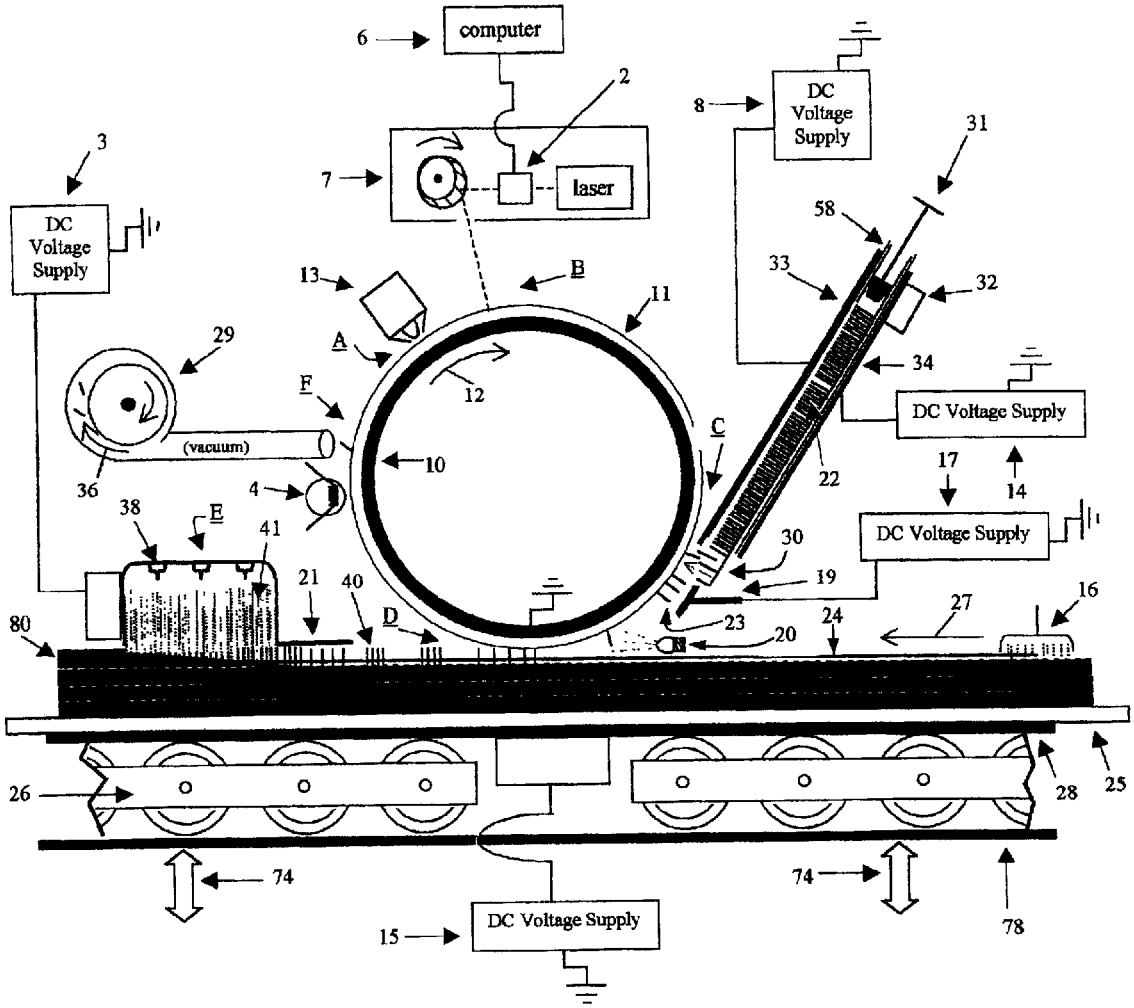
FIG. 12 is a schematic diagram that shows how multiple composite layers can be grown on the intended product substrate by repeating process steps.

In FIG. 12, multiple composite layers 80 can be grown on the intended product substrate simply by repeating the process while lifter device 74 adjusts the height of product substrate 25 relative to the transfer surface 11 and the apparatus of Matrix Growth Station E.

Figure 13:
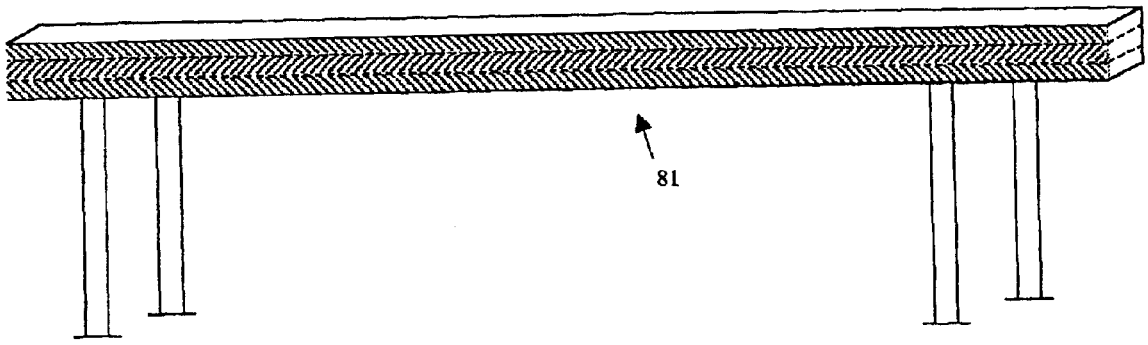
FIG. 13 shows a product made according to the present invention that can serve a structural function such as that of a table top.

FIG. 13 shows that sufficiently thick composite layers grown according to the present invention can serve a structural function such as that of a table top 81.

Figure 14:
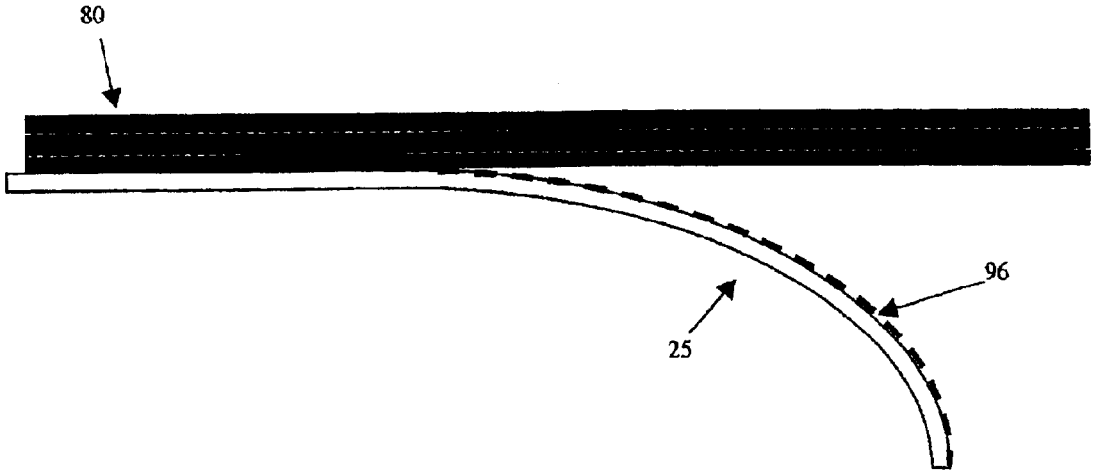
FIG. 14 shows that an intended product substrate may be removed from the composite layers grown according to the present invention if it is flexible and coated with Teflon or similar material.

FIG. 14 shows that the intended product substrate 25 may be removed from the thick, multiple composite layers 80 grown according to the present invention if it is flexible and coated with a layer 96 of Teflon.

Figure 15:
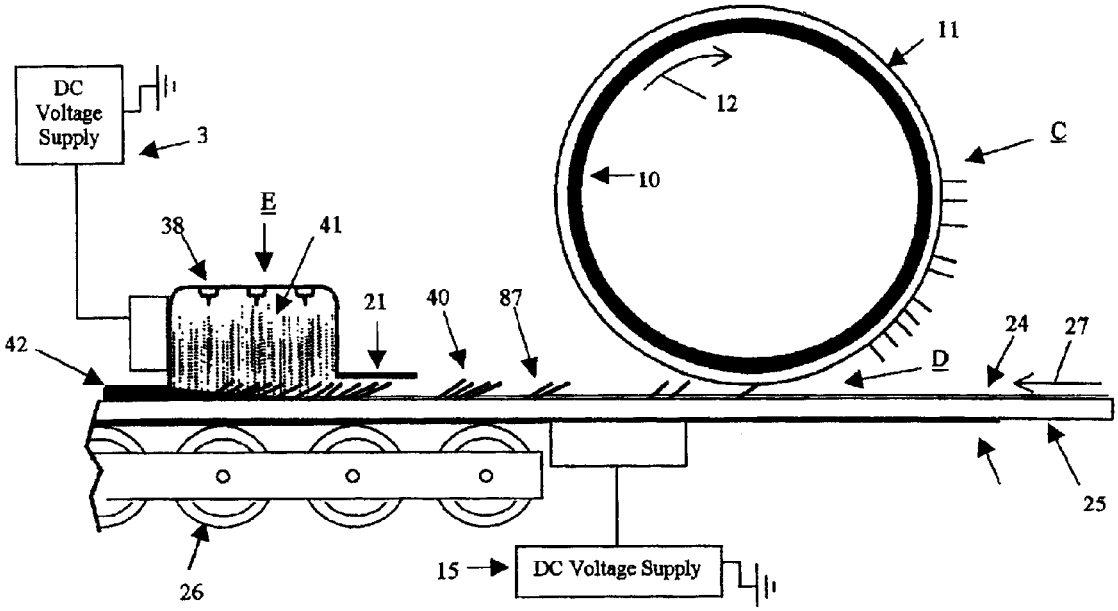
FIG. 15 is a schematic diagram that shows that the fibers or other rod-shaped components can bent away from the surface normal on the product substrate by moving the transfer surface slower (or faster) than the product substrate.

FIG. 15 shows that the fibers or other rod-shaped components 87 can be bent away from the surface normal on the product substrate 25 if the transfer surface 11 moves slower (or faster) than the product substrate 25. This may be desirable in order to present a decorative woodgrain pattern that is other than an end grain pattern.

Figure 16:
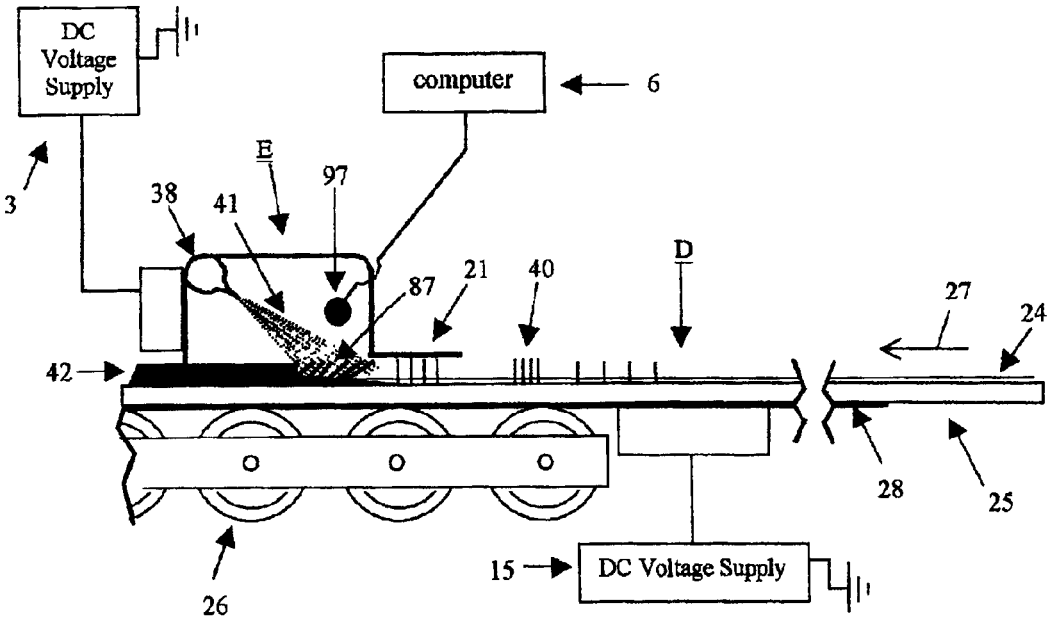
FIG. 16 is a schematic diagram that shows that the fibers or other rod-shaped components can be bent away from the surface normal on the product substrate by action of the nozzles that supply the matrix material.

FIG. 16 shows that the fibers or other rod-shaped components 87 can be bent away from the surface normal on the product substrate 25 by action of the nozzles 38 that supply the matrix material if they are directed with a horizontal component and/or by one or more narrow electrodes 97 in the vicinity of the matrix growth process, which may be controlled by computer 6.

Of course, as was illustrated in FIG. 11, the fibers or other rod-shaped components 87 can be bent away from the surface normal of the product substrate by a brush 90 that applies the matrix material 41.

Figure 17:
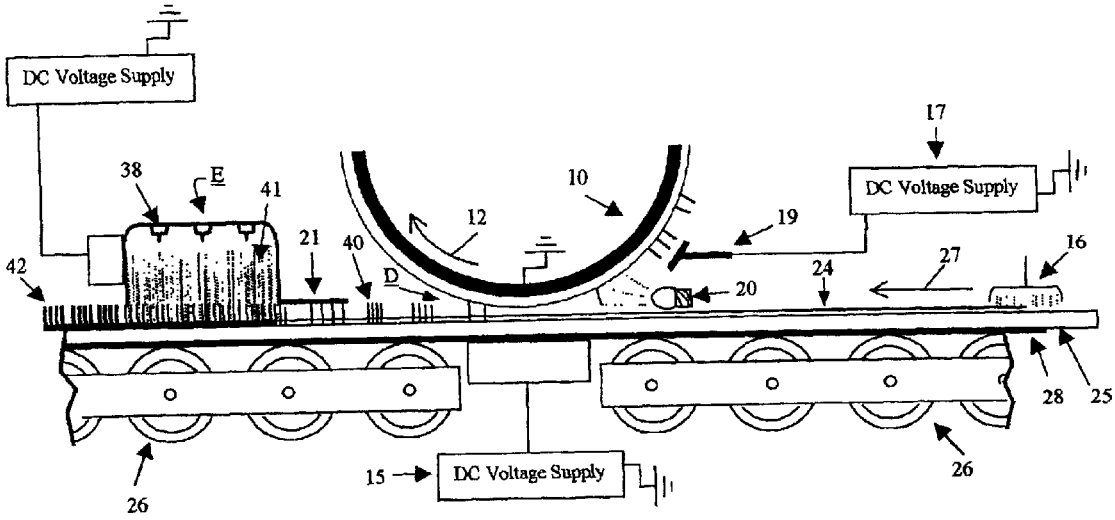
FIG. 17 is a schematic diagram that shows that the present invention can produce composite layers with a plush surface.

FIG. 17 shows that the present invention can produce a single dielectric composite layer 42 with a plush surface or multiple composite layers with a plush surface on the uppermost layer (not shown) by ending the growth of the matrix material 41 before the fibers or other rod-shaped, dielectric components 40 are completely submerged.

Figure 18:
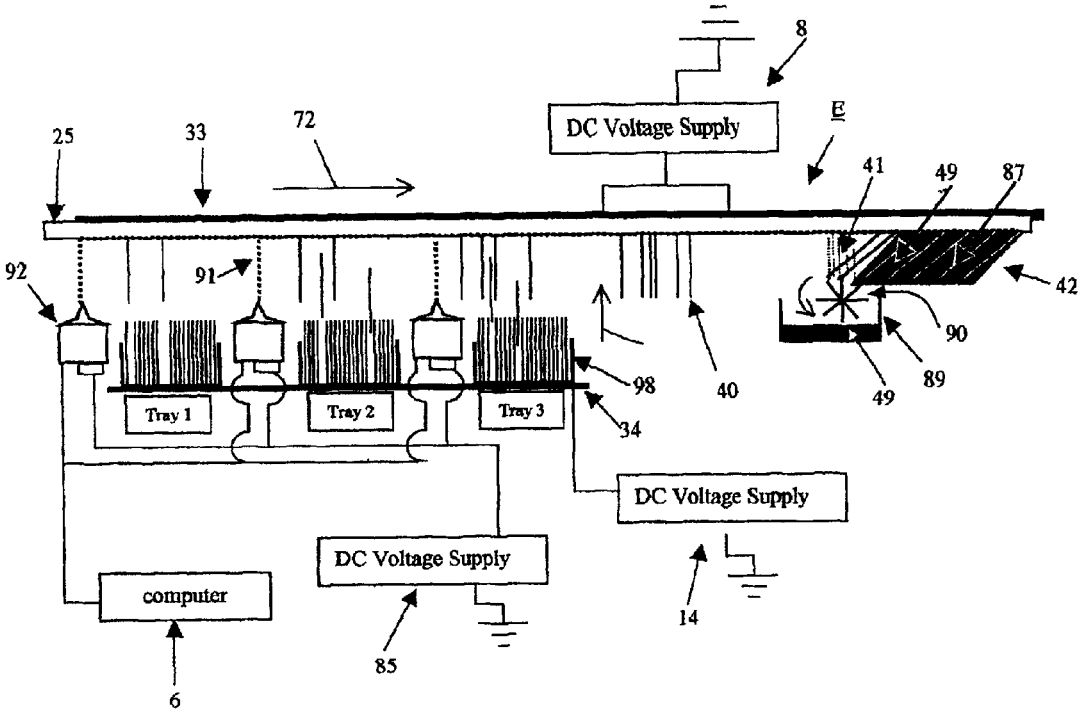
FIG. 18 is a schematic diagram that shows that fibers or other rod-shaped components of different types, e.g., of different color, can be applied by repeated application from different source trays before the matrix material is grown.

FIG. 18 shows that fibers or other dielectric, rod-shaped components 40 of different types, e.g., of different colors, can be applied from a plurality of supply trays 98. For this, one can either use repeatedly one ink-jet nozzle array impelling charged, adhesive drops, or (as is shown in FIG. 18) use a plurality of such ink-jet nozzle arrays.

The product produced by the processes above can be a woodgrain pattern, a carpet or fur on a hard or flexible substrate. The product is, in general, thicker than about 1 millimeter and thinner than 30 millimeters with fibers or other rod-shaped dielectric components that emerge on the surface in a pattern that varies laterally in two dimensions to provide a decorative effect.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A process for creating a composite decorative surface on a substrate, comprising the steps of:

(a) forming an electrostatic latent image on a transfer surface, said surface having charged regions of a first polarity and uncharged regions, said regions defining said latent image;

(b) placing a plurality of substantially rod-shaped components in a feeder device and orienting said rod shaped components so as to be substantially perpendicular to said transfer surface;

(c) placing an electrostatic charge on said components such that tips of said rod-shaped components adjacent said transfer surface have an electrostatic charge of a second polarity;

(d) feeding said components toward the transfer surface while the transfer surface is in motion so that said rod shaped components become affixed to the charged regions of the transfer surface by electrostatic attraction; and, (e) providing a substrate having an adhesive coating and placing either of said substrate or said transfer surface in motion relative to one another such that said components are transferred from the transfer surface to the substrate in a pattern determined by the latent image.

2. The process of claim 1 in which the transfer surface contains a photoconducting layer and the electrostatic latent image is produced by optical projection of a preselected image upon it.

3. The process of claim 1 wherein the transfer surface contains a photoconducting layer and the latent image is written by one or more focused light sources directed upon said transfer surface to produce a preselected pattern.

4. The process of claim 1 wherein the transfer surface comprises a dielectric material and the electrostatic latent image is written upon said surface by delivering an electrostatic charge to said surface from one or more electrodes.

5. The process of claim 1 wherein the transfer surface is a dielectric material and the electrostatic latent image is written by one or more electron beams.

6. The process of claim 1 wherein the latent image is formed on the transfer surface by plasma writing.

7. The process of claim 1 wherein the rod-shaped components are wood fibers.

8. The process of claim 1 wherein the substrate is a wood-fiber composite.

9. The process of claim 1 wherein the substrate is wood.

10. The process of claim 1 wherein the transfer surface is a flexible film.

11. The process of claim 10 wherein the flexible film is shaped to conform to said substrate by first placing it in proximity to said substrate and then conducting a fluid onto the back of the film so as to force the rod-shaped components on the film to touch the substrate.

12. The process of claim 1 wherein the transfer surface is disposed on a rotating drum.

13. The process of claim 1 wherein the transfer surface is in the shape of a cylinder and the substrate is flat.

14. The process of claim 1 wherein the transfer surface contains a photoconducting layer and wherein said rod-shaped components are transferred from the transfer surface to the substrate by illuminating the transfer surface while said rod shaped components are in close proximity to the substrate.

15. The process of claim 1 further including as step (f), the step of forming a composite matrix about the rod-shaped components on the substrate by nebulizing composite matrix source materials and spraying a mist comprising said materials onto the substrate.

16. The process of claim 15 wherein said mist and said substrate are charged electrostatically with opposite polarity charges, respectively, whereby to create electrostatic attraction between said substrate and said rod-shaped components.

17. The process of claim 15 further including as step (g), the step of causing said rod shaped components to tip at an angle relative to said substrate.

18. The process of claim 17 wherein step (g) is accomplished by executing step (f) with the composite matrix material in liquid form with a horizontal component of application force.

19. The process of claim 17 wherein step (g) is accomplished by brushing the rod-shaped components on the adhesive substrate prior to formation of the composite matrix about them.

20. The process of claim 17 wherein step (g) is accomplished by applying electrostatic forces produced by narrow electrodes disposed in the vicinity of the substrate after step (f).

21. The process of claim 1 wherein a patterned substrate as obtained in step (e) is subjected to additional process steps including repeating steps (a) through (e).

22. The process of claim 1 wherein said substrate includes a plurality of composite layers, a top layer comprising an intended layer and further including the step of removing said intended layer from said composite layers following the completion of step (e).

23. The process of claim 22 wherein the substrate is coated with Teflon or other similar material.

24. The process of claim 1 further including the step of applying an electrostatic field across said transfer surface after the execution of step (d) whereby to increase the tendency of the rod-shaped components to stand perpendicular to the transfer surface.

25. The process of claim 1 wherein the rod-shaped components are oriented prior to attachment to the electrostatic latent image on the transfer surface by directing a fluid through said components in a desired direction.

26. The process of claim 1 wherein the substrate is a polymer or plastic.

27. The process of claim 1 wherein the substrate is a fiberglass.

28. The process of claim 1 wherein the substrate is cellulose, hemicellulose, protein, saccharide, or a combination thereof.

29. The process of claim 1 wherein the substrate is leather and a product produced according to said process is artificial fur.

30. The process of claim 1 wherein the substrate is a textile and a product produced according to the process is a carpet.

31. A process for the creation of a dielectric, composite decorative surface having a thickness greater than 1 mm on a substrate comprising the steps of:

(a) applying an adhesive coating to the surface of the substrate;

(b) forming an electrostatic latent image on the surface of said substrate;

(c) attaching to said substrate one end of each of a plurality of dielectric aligned, flexible rod-shaped components in a pattern determined by the latent image on the substrate; and, (d) growing a dielectric composite matrix around the rod-shaped components upon the substrate.

32. The process of claim 31 wherein the electrostatic latent image is written by means of one or more electron beams.

33. The process of claim 31 wherein the electrostatic latent image is written by means of a plasma writing system.

34. The process of claim 31 wherein step (b) is accomplished by the application of charged drops of adhesive by an array of drop-on-demand, piezoelectric ink-jet nozzles.

35. The process of claim 34 wherein steps (a) (b) and (c) are repeated prior to step (d).

36. The process of claim 31 further including prior to step (c) the step of impressing upon a plurality of rod-shaped dielectric components an electrostatic charge.

* * * * *

UNITED STATES PATENT AND TRADEMARK OFFICE

CERTIFICATE OF CORRECTION

PATENT NO. : 6,756,174 B2
DATED : June 29, 2004
INVENTOR(S) : Van Vechten et al.

It is certified that error appears in the above-identified patent and that said Letters Patent is hereby corrected as shown below:

Column 3,
Line 2, insert -- ...be… -- between "can" and "bent" to read -- ...can be bent… . --

Signed and Sealed this

Third Day of May, 2005

JON W. DUDAS
*Director of the United States Patent and Trademark Office*